United States Patent [19]

Lawrence

[11] Patent Number: 4,961,262

[45] Date of Patent: Oct. 9, 1990

[54] EYEBROW SHAVING APPARATUS

[76] Inventor: Virginia M. Lawrence, 934 S. Larch Ave., Inglewood, Calif. 90301

[21] Appl. No.: 361,497

[22] Filed: Jun. 5, 1989

[51] Int. Cl.[5] ..... B26B 21/00; B26B 19/00; B26B 19/44

[52] U.S. Cl. ..... 30/32; 30/31; 30/49

[58] Field of Search ..... 30/31, 32, 196, 329, 30/345.49, 346, 49

[56] References Cited

U.S. PATENT DOCUMENTS

| | | | |
|---|---|---|---|
| 2,127,010 | 8/1938 | Sampson | 30/32 |
| 2,547,376 | 4/1951 | Crawford | 30/32 |
| 2,915,818 | 12/1959 | Meohas | 30/32 |
| 4,709,475 | 12/1987 | Phung | 30/31 |
| 4,782,590 | 11/1988 | Pope | 30/32 |
| 4,845,848 | 7/1989 | Strickland | 30/32 |

*Primary Examiner*—Douglas D. Watts
*Assistant Examiner*—Paul M. Heyrana, Sr.
*Attorney, Agent, or Firm*—Robert J. Schaap

[57] ABSTRACT

An eyebrow shaving apparatus comprised of an elongate handle having at least one blade and preferably a pair of blades mounted on a flat portion of the handle. The blades are preferably arcuate in shape so as to enable an easy trimming or shaving of a user's eyebrows. The blades have sharp edges facing away from the flat surface of the handle and are arranged so that the entire shaving apparatus can easily be manipulated by the user. Furthermore, the handle is provided with an angularly bent portion so as to enable the user to grasp the handle and easily trim the eybrows while also displacing the user's hands from a line of sight. In this way, a user can carefully and easily munipulate the apparatus while viewing in a mirror. The apparatus is also highly effective and relatively safe in use.

17 Claims, 1 Drawing Sheet

EYEBROW SHAVING APPARATUS

BACKGROUND OF THE INVENTION

1. Field of the Invention.

This invention relates in general to certain new and useful improvements in an eyebrow shaving apparatus and method, and more particularly, to an improved eyebrow shaving apparatus and method which is provided with an elongate handle and an arcuately shaped blade thereon and which enables easy manipulation by a user and is thereby relatively safe in use.

2. Brief Description of the Prior Art.

In recent years, it has become a fad, if not a well established dress code, for women to trim their eyebrows so that the eyebrows do not present a "bushy-type" appearance. Thus, in accordance with this dress code, the eyebrows should be relatively thinned-out, that is, relatively low in hair density. However, this is relatively difficult to accomplish in actual practice and requires the person wishing to treat her eyebrows to obtain the services of a licensed cosmetologist.

Some women have attempted to trim their eyebrows with conventional razor blades, including the use of straight edged razor blades. However, the straight edge razor blade and for that matter, the so-called, safety razors are not adapted for trimming of eyebrows. Rather, they are adapted for the shaving of hair from surfaces such as legs, cheeks or the like. Accordingly, serious accidents do result when a woman attempts to trim her eyebrows using a so-called safety razor or a straight edge razor.

Another significant problem which arises when an individual attempts to trim her own eyebrows is the fact that the user can only do so by examining the eyebrow areas in a mirror. Moreover, inasmuch as conventional safety razors and straight edge razors are designed for shaving cheeks and legs and the like, they do not have an offset portion in which to grasp a handle. Accordingly, the user's hand blocks the line of sight of the user. As a result, the user is not capable of easily trimming both eyebrows in the same way. As a simple example, the user may inadvertently remove more hair from one side than the other, or may trim one side longer than the other. As a result, the user then removes the entire pair of eyebrows by shaving the same and resorts to coloring with eyebrow pencils and like implements.

In addition, many women simply completely resort to a shaving of the eyebrows on a periodic basis and rely only on the application of false eyebrows or the coloring of the skin in the area in which the eyebrows would normally exist in order to obtain the desired eyebrow appearance.

Heretofore, there has not been any effective device which permits a trimming of the eyebrows on a relatively safe basis and which is highly effective in use.

OBJECTS OF THE INVENTION

It is, therefore, one of the primary objects of the present invention to provide a eyebrow shaving apparatus for the trimming or shaving of eyebrows and which is highly effective and relatively safe in use.

It is another object of the present invention to provide an eyebrow shaving apparatus of the type stated which is comprised of a blade supporting plate along with at least one trimming and shaving blade mounted on the plate and extending outwardly therefrom for engagement with the eyebrows of the user.

It is a further object of the present invention to provide an eyebrow shaving apparatus of the type stated in which the shaving blade is arcuately shaped in order to efficiently remove eyebrow hair in a relatively safe manner.

It is an additional object of the present invention to provide an eyebrow shaving apparatus of the type stated in which the handle is provided with an angularly struck portion to facilitate grasping thereof without interfering with the line o sight of the user.

It is another salient object of the present invention to provide a method of shaving eyebrows which is highly effective and relatively safe in use.

With the above and other objects in view, my invention resides in the novel features of form, construction, arrangement and combination of parts presently described and pointed out in the claims.

BRIEF SUMMARY OF THE DISCLOSURE

The present invention relates, in general terms to an eyebrow shaving apparatus for the trimming or shaving of eyebrows. The apparatus is effective in either partially removing hair from the eyebrows or otherwise removing all of the hair of the eyebrows. Moreover, the shaving apparatus is highly efficient in use and is also relatively safe eve though it employs a razor sharp blade.

The eyebrow shaving apparatus comprises a blade supporting plate with at least one trimming and shaving blade mounted on the plate. The trimming and shaving blade extends transversely across the plate and projects outwardly therefrom. Further, the blade has an arcuate shape between its transverse sides with an outer razor sharp edge.

In a more preferred embodiment of the invention, the blade is mounted at one end of the blade supporting plate. Further, the blade extends from one longitudinal edge of the supporting plate to the other longitudinal edge thereof The eyebrow shaving apparatus is also comprised of an angularly located handle which extends outwardly from the blade supporting plate and is located so that the hand of the user may grasp the handle without substantially interfering with the line of sight of the user in a mirror.

In one embodiment, the handle may be integral with the blade supporting plate. Thus, the blade supporting plate effectively serves as a handle with an angularly struck portion. In another embodiment, the handle may be removably secured to the blade supporting plate. In this latter embodiment of the eyebrow shaving apparatus storage and/or transport is facilitated.

In still a more preferred embodiment of the present invention, the eyebrow shaving apparatus comprises a pair of spaced apart trimming and shaving blades which are mounted on the plate. These blades are longitudinally spaced apart from each other. Moreover, each of the trimming and shaving blades extend transversely across the blade supporting plate and project outwardly therefrom. Further, each blade has an arcuate shape between its transverse edges with an outer razor sharp edge.

This invention possesses many other advantages and has other purposes which may be made more clearly apparent from a consideration of the forms in which it may be embodied. These forms are shown in the drawings forming a part of and accompanying the present specification. They will now be described in detail for the purposes of illustrating the general principles of the invention, but it is to be understood that such detailed description is not to be taken in a limiting sense.

BRIEF DESCRIPTION OF THE DRAWINGS

Figure 1:
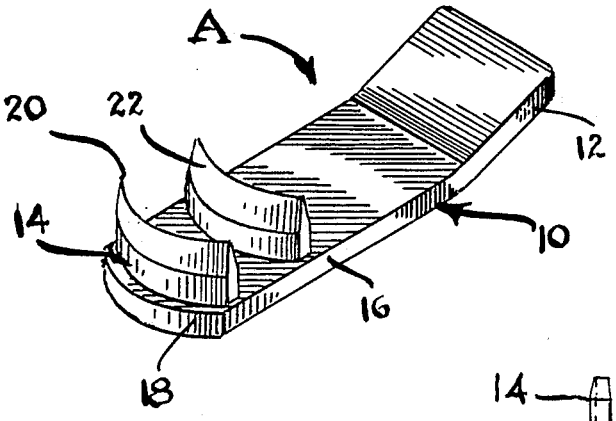
Figure 2:
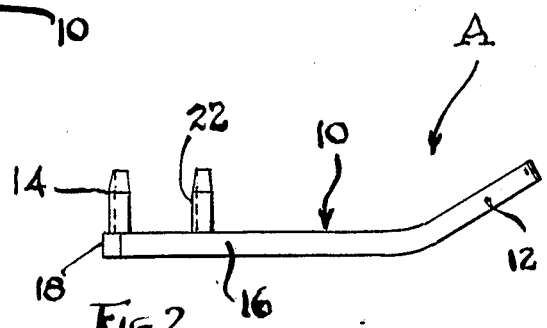
Figure 3:
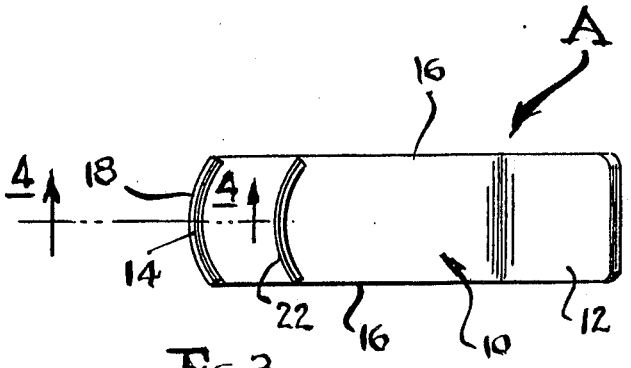
Figure 4:
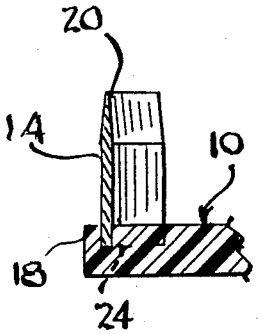

Having thus described the invention in general terms, reference will now be made to the accompanying drawings (one sheet) in which:

FIG. 1 is a perspective view of an eyebrow shaving apparatus constructed in accordance with and embodying the present invention;

FIG. 2 is a side elevational view of the eyebrow shaving apparatus;

FIG. 3 is a top plan view of the eyebrow shaving apparatus;

FIG. 4 is a horizontal sectional view taken along line 4—4 of FIG. 3; and

Figure 5:
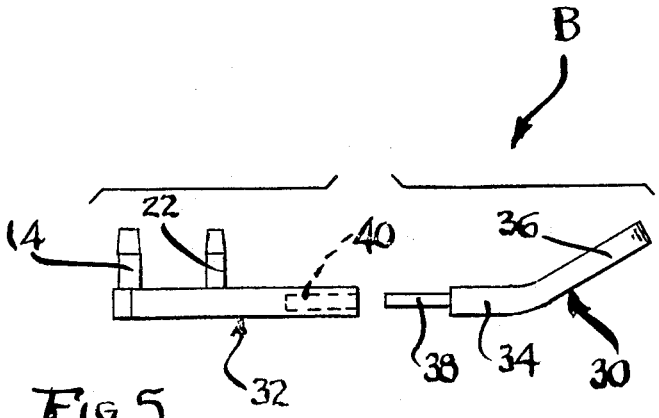

FIG. 5 is an exploded side elevational view of a modified form of eyebrow shaving apparatus constructed in accordance with and embodying the present invention.

DETAILED DESCRIPTION OF PREFERRED EMBODIMENTS

Referring now in more detail and by reference characters to the drawings which illustrate one of the preferred embodiments of the present invention, A designates an eyebrow shaving apparatus comprised of a blade supporting plate 10. This blade supporting plate has a portion which is relatively flat and an integrally formed outwardly extending handle 12 secured thereto. The handle 12 is angularly struck with respect to the plane of the blade supporting plate 10. In this case, the handle is struck upwardly with respect to the orientation of the blade supporting plate, 10 in the embodiment as illustrated.

The blade supporting plate and the integrally formed handle 12 could be formed of any suitable material which is light in weight but yet structurally sufficient to retain one or more shaving blades thereon. Thus, and for this purpose, the blade supporting plate and the integrally formed handle could be formed of any suitable plastic material such as polyethylene, polypropylene, etc. In like manner, if desired, the blade supporting plate 10 and the associated handle 12 could be formed of reinforced plastic composite materials such as fiberglass-resin epoxy materials and the like. Also, if desired, the blade supporting plate 10 and the associated handle 12 could be formed of any suitable metal such as aluminum or the like.

Mounted on the blade supporting plate 10 at one end thereof is a first trimming and shaving blade 14. By reference to FIGS. 2 and 3, it can be observed that the shaving and trimming blade 14 is arcuately shaped between longitudinal edges 16 of the blade supporting plate 10. In this respect, it can also be observed that the forward edge 18 of the blade supporting plate 10 is arcuately shaped conforming to the shape of the shaving and trimming blade 14. The shaving and trimming blade 14 has an upper edge 20 which is also arcuately shaped in accordance with the shape of the blade 14. This upper edge is a razor sharp edge. In this respect, the blade 14 could be formed of razor blade material in the same manner as a razor blade and with an upper honed edge 20.

Also mounted on the blade supporting plate 10, in longitudinally spaced relationship to the blade 14, is a second blade 22. This blade 22 is substantially similar in construction to the blade 14 and is also arcuately shaped between the longitudinal edges 16 of the blade supporting plate 10. Furthermore, it is also provided with an upper razor sharp edge 20.

The use of an arcuately shaped blade has been found to be highly effective in accordance with the present invention in that it reduces the possibility of cuts and abrasions to the user of the apparatus. Moreover, the arcuately shaped blade more easily conforms to the bone structure of the head underlying the eyebrows. Further, this arcuate shape also has been found to facilitate use without injury and also facilitates maintaining a proper line of sight when the viewer examines the shaving process in a mirror.

The use of a pair of the arcuately shaped blades has also been found to be effective particularly, when attempting to remove the entire eyebrow. It can be appreciated that each pass of the eyebrow shaving apparatus only increases the possible attendant risk of injury to the user. Therefore, when utilizing a pair of spaced apart blades, it is not necessary to make two passes of the shaving blade across the eyebrow in order to remove the complete eyebrow. In this way, the entire eyebrow can be removed usually with a single pass.

The shaving and trimming blades 14 and 22 ma be mounted to the blade supporting plate 10 by any suitable technique. In the embodiment as illustrated, the blade 14, for example, has a lower edge which fits within a slot 24 formed in the upper surface of the blade supporting plate 10. However, any other convenient technique for mounting the blade to the blade supporting plate may be employed.

It can be observed that the handle 12 is angularly struck with respect to the blade supporting plate 10. This construction is provided so that the hand of the user is removed from the line of sight of the user. In this way, the eyebrow shaving apparatus is easier to use and moreover, it becomes a much safer way of shaving and trimming an eyebrow.

FIG. 5 illustrates another embodiment of an eyebrow shaving apparatus B constructed in accordance with and embodying the present invention. This embodiment B of the eyebrow shaving apparatus is similar to the previously described embodiment A except that it is provided with a handle 30 removable from a blade supporting plate 32. In this respect, the blade supporting plate 32 is substantially similar in construction to the plate 10.

The handle 30 is provided with a relatively flat plate section 34 in generally horizontal alignment with the blade supporting plate 32. This generally flat portion 34 integrally merges into an angularly and upwardly struck handle section 36, as best illustrated in FIG. 5 of the drawings. The relatively flat horizontally disposed section 34 is provided with a tab or so-called "tongue" 38 which fits within a correspondingly sized and shaped groove or so-called "socket" 40 formed within the blade supporting plate 32. In this way, the tab 38 can fit within the groove 40 in a tight fitting but nevertheless removable engagement to permit the handle 30 to become attached to the blade supporting plate 32. Moreover, the handle 30 can be easily removed from the blade supporting plate 32 by merely pulling the tab 38 out of the groove 40.

Thus, there has been illustrated and described a unique and novel eyebrow shaving apparatus which permits the trimming or shaving of eyebrows and which is highly effective and relatively safe in use. The eyebrow shaving apparatus therefore fulfills all of the objects and advantages which have been sought. It should be understood that many changes, modifications, variations and other uses and applications will become apparent to those skilled in the art after considering this specification and the accompanying drawings. Therefore, any and all such changes, modifications, variations, and other uses and applications which become apparent to those skilled in the art after considering this specification and the drawings are deemed to be covered by the invention.

Having thus described the invention, what I desire to claim and secure by letters patent is:

1. An eyebrow shaving apparatus for trimming or shaving an eyebrow, said apparatus being comprised of:

a) a blade supporting plate having a pair of longitudinally extending sides and transverse ends, b) a trimming and shaving blade mounted on said plate and extending transversely across said plate and projecting outwardly therefrom, said blade having an permanently fixed arcuate shape between its longitudinally extending sides with an outer razor sharp edge, and c) a handle extending outwardly from said blade supporting plate in angular relationship to the plane of the blade supporting plate so that a user may grasp the handle trim his or her eyebrows without substantially blocking the line of sight of the user.

2. The eyebrow shaving apparatus of claim 1 further characterized in that said blade is mounted on said plate at one end thereof.

3. The eyebrow shaving apparatus of claim 2 further characterized in that said blade extends between one longitudinal edge of the blade supporting plate and the opposite longitudinal edge thereof.

4. The eyebrow shaving apparatus of claim 2 further characterized in that said handle extends outwardly from said blade supporting plate and projects outwardly on the same side of said plate as the razor sharp edge so that a hand of a user may grasp the handle without substantially blocking a line of sight of a user in a mirror.

5. The eyebrow shaving apparatus of claim 4 further characterized in that said handle is integral with said blade supporting plate.

6. The eyebrow shaving apparatus of claim 4 further characterized in that said handle is removably secured to said blade supporting plate.

7. An eyebrow shaving apparatus for trimming or shaving an eyebrow, said apparatus being comprised of:

a) a blade supporting plate, b) a first trimming and shaving blade mounted on said plate and extending transversely across said plate and projecting outwardly therefrom, said first blade having a permanently fixed arcuate shape between its transverse sides with an outer razor sharp edge, c) a second trimming and shaving blade mounted on said plate and extending transversely across said plate and projecting outwardly therefrom, said second blade having a permanently fixed arcuate shape between its longitudinally extending sides with an outer razor sharp edge, and d) a handle extending outwardly from said blade supporting plate in angular relationship to the plane of the blade supporting plate so that a user may grasp the handle and trim his or her eyebrows without substantially blocking the line of sight of the user.

8. The eyebrow shaving apparatus of claim 7 characterized in that said first blade is mounted on said plate adjacent one end thereof.

9. The eyebrow shaving apparatus of claim 8 characterized in that each of said blades extends between one longitudinal edge of the blade supporting plate and the opposite longitudinal edge thereof.

10. The eyebrow shaving apparatus of claim 7 characterized in that said handle extends outwardly from said blade supporting plate and projects outwardly on the same side of the plate as the razor sharp edges so that a hand of a user may grasp the handle without substantially blocking a line of sight of a user in a mirror.

11. The eyebrow shaving apparatus of claim 10 characterized in that said handle is integral with said blade supporting plate.

12. The eyebrow shaving apparatus of claim 12 characterized in that said handle is removably secured to said blade supporting plate.

13. An eyebrow shaving apparatus for trimming or shaving an eyebrow, said apparatus being comprised of:

a) a substantially rigid relatively flat blade supporting plate having a pair of longitudinally extending sides and transverse ends, b) a trimming and shaving blade mounted on said plate and extending transversely across said plate from one longitudinal side to the opposite longitudinal side thereof and projecting outwardly therefrom in generally perpendicular relationship thereto closely adjacent one transverse end thereof, and said blade having an outwardly presented permanently fixed arcuate shape between its longitudinal sides with an upper razor sharp edge, and c) a handle extending outwardly from said blade supporting plate in angular relationship to the plane of the blade supporting plate so that a user may grasp the handle and trim his or her eyebrows without substantially blocking the line of sight of the user.

14. The eyebrow shaving apparatus of claim 13 further characterized in that said handle extends outwardly from said blade supporting plate and projects outwardly on the same side of said plate as the razor sharp edge so that a hand of a user may grasp the handle without substantially blocking a line of sight of a user in a mirror.

15. The eyebrow shaving apparatus of claim 14 further characterized in that said handle is integral with said blade supporting plate.

16. The eyebrow shaving apparatus of claim 14 further characterized in that said handle is removably secured to said blade supporting plate.

17. The eyebrow shaving apparatus of claim 14 further characterized in that said trimming and shaving blade is a first trimming and shaving blade, and said apparatus comprises a second trimming and shaving blade mounted on said plate and extending transversely across said plate and projecting outwardly therefrom from one longitudinal side to the opposite longitudinal side thereof, said second blade also having an outwardly projected permanently fixed arcuate shape between its longitudinal sides with an outer razor sharp edge.

* * * * *